US005407381A

United States Patent [19]

Schaefer et al.

[11] Patent Number: 5,407,381

[45] Date of Patent: Apr. 18, 1995

[54] ELECTRIC HAND MACHINE TOOL, AND ROTATABLE HANDLE OR APPENDIXES

[75] Inventors: Dieter Schaefer, Leonberg; Erich Borst, Leinfelden-Echterdingen; Anton Reiter, Schoenaich; Willi Sproesser, Neuhausen; Manfred-Wilhelm Staebler, Leinfelden-Echterdingen; Fritz Kuettner, Waldenbuch; Bernhard Eicher, Filderstadt, all of Germany

[73] Assignee: Robert Bosch GmbH, Stuttgart, Germany

[21] Appl. No.: 971,866

[22] Filed: May 10, 1993

[30] Foreign Application Priority Data

Jul. 17, 1990 [DE] Germany ..... 40 22 668.9

[51] Int. Cl.[6] ..... B24B 23/00; B24B 27/08

[52] U.S. Cl. ..... 451/358; 451/360; 451/344

[58] Field of Search ..... 173/170; 51/170 R, 170 T, 51/170 MT, 170 PT; 30/517, 519; 451/360

[56] References Cited

U.S. PATENT DOCUMENTS 2,730,635 1/1956 McCabe ..... 173/170

4,757,613 7/1988 Baudreau et al. ..... 30/383

5,065,476 11/1991 Dohse et al. ..... 16/114 R 5,201,146 4/1993 Fushiya ..... 51/170 R

FOREIGN PATENT DOCUMENTS 643674 5/1964 Belgium .

0267472 5/1988 European Pat. Off. .

3603174 8/1987 Germany .

*Primary Examiner*—Bruce M. Kisliuk

*Assistant Examiner*—Yasser El-Gamal

*Attorney, Agent, or Firm*—Michael J. Striker

[57] ABSTRACT

In an electric hand machine tool, particularly an angle grinding machine, for the purpose of ergonomic handling the handle, together with the switch bar, is designed to be rotatable, relative to the tool mounting on the gear head (11). For the rapid, problem-free changing of the position of the handle relative to the tool mounting, the handle (12) can be locked against rotation on the motor casing, containing the electric drive, in at least two turned positions by a manually operable locking device, and can be clamped on the motor casing by a manually operable clamp device. In a preferred embodiment the locking device (40) and clamp device are coupled together by constraint and are operated simultaneously by means of a single tightening lever.

31 Claims, 7 Drawing Sheets

ELECTRIC HAND MACHINE TOOL, AND ROTATABLE HANDLE OR APPENDIXES

BACKGROUND OF THE INVENTION

The present invention relates to an electric hand machine tool, particularly an angle grinding machine.

In particular, the present invention relates to an electric hand machine tool which has a motor casing containing an electric drive with a gear head projecting from one end face of the casing and carrying a tool mounting, and a handle extending from the other end face of the casing and containing an ergonomically situated switch bar for switching on the electric drive.

Hand machine tools, paricularly angle grinding machines, of the above mentioned type are at the present time equipped exclusively with an on/off switch operated by means of a switch bar. The switch bar is situated on the underside of the handle and is operated by at least one finger, while the handle is gripped, and held in the operating position during working with the machine. The ergonomic design of the handle, such as its cross-sectional shape and angle of inclination to the axis of the machine, is optimised for a single working position of the machine. The same also applies to the arrangement of the switch bar, which is often provided with a switch interlock and a switch lock which can be rapidly and reliably operated in this working position.

Some hand machine tools are used in more than one working position for various operations. An angle grinding machine, for example, is used not only for grinding or scouring but also for cutting, for example cutting stone slabs. The optimum working position discussed above is usually provided for the scouring working position in which the grinding wheel points downwards, that is to say lies approximately parallel to the switch bar. In cutting work, on the other hand, the angle grinding machine is turned 90° to the left or right about its longitudinal axis, so that the cutting wheel is approximately at right angles to the workpiece. As a result of this rotation, the handle and switch bar are brought into an unfavourable position relative to the hand gripping the handle. If the machine is turned to the left and the handle is gripped by the right hand, the switch bar comes to lie in the ball of the thumb. If the machine is turned to the right and held by the right hand, the switch bar can be held and operated only by the thumb. In neither case is secure, untiring holding of the switch bar possible. In addition, in the event of danger the position of the switch interlock and switch lock prevents sufficiently rapid reaction and switching-off.

In order to obviate the above mentioned disadvantages, in one known angle grinding machine the gear head and tool mounting for the grinding and cutting wheel are mounted detachably on the motor casing. After unscrewing four fastening screws and removing them from the screw holes, the gear head can be turned 90° to the right or left on the motor casing centring device. The screws then have to be re-inserted and the gear head screwed fast to the motor casing. The dismantling and refitting of the gear head on the motor casing is relatively laborious, so that this known angle grinding machine is not suitable for applications in which adjustments have to be made frequently.

SUMMARY OF THE INVENTION

Accordingly, it is an object of the present invention to provide an electric hand machine tool, particularly an angle grinding machine, which eliminates the disadvantages of the prior art.

In keeping with these objects and with others which will become apparent hereinafter, one feature of the present invention resides, briefly stated, in an electric hand machine tool, particularly an angle grinding machine in which the handle or the gear head is held rotatably on the motor casing, can be locked against rotation on the motor casing in at least two turned positions by means of a manually operable locking device, and can be clamped on the motor casing by means of a manually operable clamp device.

When the electric hand machine tool is designed in accordance with the present invention, it has the advantage of simple and rapid handling. After manually releasing the clamping and locking devices—that is to say without assembly tools—the handle or gear head dan be turned on the motor casing until the relative positions of the tool mounting and switch bar which are favourable for the new working position of the machine are obtained. The locking device is then reactivated and the clamping device operated. The locking and clamping devices ensure optimum safety for the operator, since on the one hand a rotation of the handle or gear head relative to the motor casing is reliably prevented, and on the other hand a firm connection is made between the parts which are movable relative to one another. Both devices are of simple, space-saving construction and are insensitive to dirt and dust.

In a preferred embodiment of the invention, the clamp device is constructed in a particularly expedient manner by providing the handle or gear head with a shell-like casing which engages by means of a radially projecting collar in a groove extending around the motor casing and, in the collar region, has a longitudinal slot, and by providing the clamp device with a tightening screw which extends transversely to the longitudinal slot and can be screwed into a screw thread by means of a tightening lever, so that the casing regions on both sides of the slot can be moved towards one another, thus reducing the width of the longitudinal slot. The collar is thereby clamped radially in the groove extending around the motor casing.

Through the provision of a toothed clutch, which can be released by axial movement of a coupling part, between the tightening screw and the tightening lever in the locking device according to another embodiment of the invention, adjustment of the clamping force of the tightening screw is possible and it is ensured that the tightening lever in its clamping position always assumes an accurately defined end position.

In another preferred embodiment of the invention, the locking device is expediently formed by providing in the motor casing a number of locking slots which corresponds to the number of required working positions of the machine, said slots being offset by corresponding angles of rotation, and disposing swivellably in the shell casing a locking cam capable of engaging positively in in each case one of the locking slots.

Constrained coupling of the locking and clamping devices is achieved in a preferred embodiment of the invention by the fact that the locking cam is mounted on and rotatable with a coupling sleeve which coaxially surrounds the tightening screw and is in turn operatively connected to one of the coupling parts of the toothed clutch by means of a claw clutch. This combination of the clamp and locking devices to form a single constructional unit has the advantage that only a single operating lever is provided and thus, in addition to simpler handling, it is ensured that locking is always accompanied by clamping, and vice versa. In contrast to separate constructions for the locking and clamping devices, it is not necessary, after every change, to check separately whether both devices are activated.

In another embodiment of the invention, a contact element of a breaker contact is in each case disposed in the locking slots, on the one hand, and on the locking cam of the locking device, on the other hand, said breaker contact being disposed in the electric connecting line between the on/off switch, which is operated by the switch bar, and the electric drive motor and being so constructed that it is closed only when the locking cam engages in the locking slot. It is thereby ensured that the circuit to the electric drive motor will be interrupted when the handle or gear head is moved and be restored only after correct locking and clamping have been achieved.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
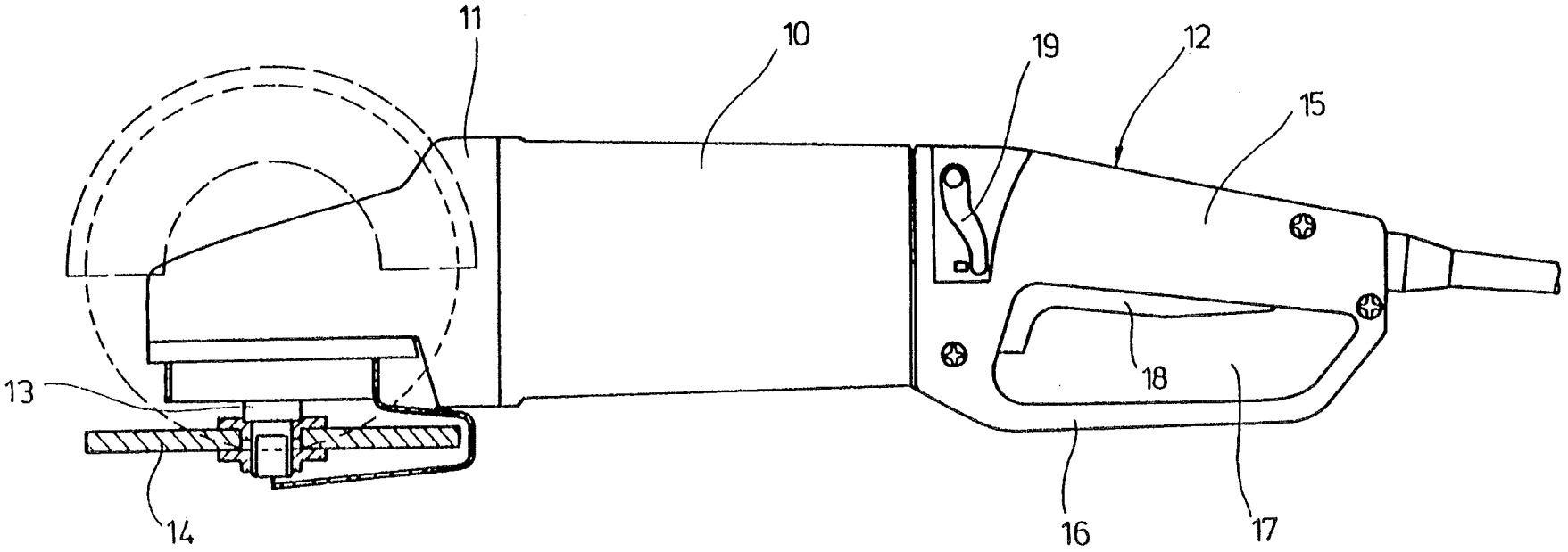
FIG. 1 is a side view of an electric angle grinding machine.

The electric angle grinding machine shown in side view in FIG. 1, given as an example of embodiment for an electric hand machine tool in general, comprises a motor casing 10 containing an electric drive motor (not shown), from one end face of which casing a gear head 11 projects, while a handle 12 extends at the other end face of said casing. At the end of the gear head 11, a tool mounting 13 can be seen, in which in this case a grinding wheel 14 is held. The gridding wheel in the position shown in solid lines, is used for scouring, while in the position shown in dashed lines, turned 90°, is used for cutting. The handle 12 has a stem grip 15, around which the hand is placed while working with the angle grinding machine. It also has a bow 16 integrally attached thereto and covering the stem grip 15 on the underside, while leaving an opening 17 through which the fingers can pass, and providing protection at the bottom for the fingers placed around the stem grip during work with the angle grinding machine. On the underside, facing the bow 16, of the stem grip 15 a switch bar 18 projects into the passage opening 17 and operates an on/off switch for the electric drive motor. The gear head 11 is made fixed, preferably integrally joined, to the motor casing 10, while the handle 12 can be turned relative to the motor casing 10 and be fastened by means of a locking device and a clamping device, both devices are operated by means of a tightening lever 19, in determined turned positions on the motor casing 10.

As can be seen in particular in FIG. 2, the handle 12 has a shell-like casing, referred to hereinbelow as shell casing 20, which, for the purpose of mounting the handle 12 rotatably on the motor casing 10, engages by means of a radially projecting collar 21 in a groove 22 extending around the motor casing. In the collar region 21, the shell casing 20 has a longitudinal slot 23 (FIG. 3) which enables the collar 21 to be clamped firmly radially at the bottom of the annular groove 22 by means of the clamp device 24. For manufacturing reasons, the shell casing 20 is made of two half-shells which are held together by three screw connections 25. In FIG. 3, the two half-shells 201 and 202 and one of the screw connections 25 can be seen. In this arrangement, the longitudinal slot 23 is formed in the upper side, remote from the bow 16, of the shell casing 20, at the joint between the two half-shells 201, 202.

The clamp device 24 consists of a tightening screw 26 which extends directly beneath the longitudinal slot 23, transversely to the casing axis, and passes through a bore 27 in one half-shell 201, and can be screwed into a threaded hole 28 provided in the other half-shell 202. The tightening screw 26 is operated by means of the tightening lever 19, as will be explained in detail below. At the end of the tightening screw 26 remote from the threaded hole 28, said screw is fastened to a first coupling part 31 of a toothed clutch 30. The part is supported by a coupling sleeve 29 against a wall region which surrounds the bore 27 and is formed by an external cavity 33 in the half-shell 201. On a portion of reduced diameter, the first coupling part 31 carries a toothed ring provided with radially projecting coupling teeth 34, in which mesh similar coupling teeth 34 of a toothed ring on the second coupling part 32 coaxially surrounding the first coupling part 31. The second coupling part 32 is integral with the tightening lever 19 projecting at right angles from the second coupling part 32 and extending laterally on the shell casing 20. A bolt 35 carrying a collar 36 is screwed into the end face of the first coupling part 31. A compression spring 38 is supported between the collar 36 and an annular web 37 in the interior of the hollow-cylindrical coupling part 32. The solid length of the compression spring 38 and the axial length of the coupling teeth 34 are adapted to one another such that, by pulling out the tightening lever 19, away from the shell casing 20, the second coupling part 32 can be moved axially to a sufficient extent to bring the coupling teeth 34 of the first and second coupling parts 31, 32 out of engagement.

Figure 2:
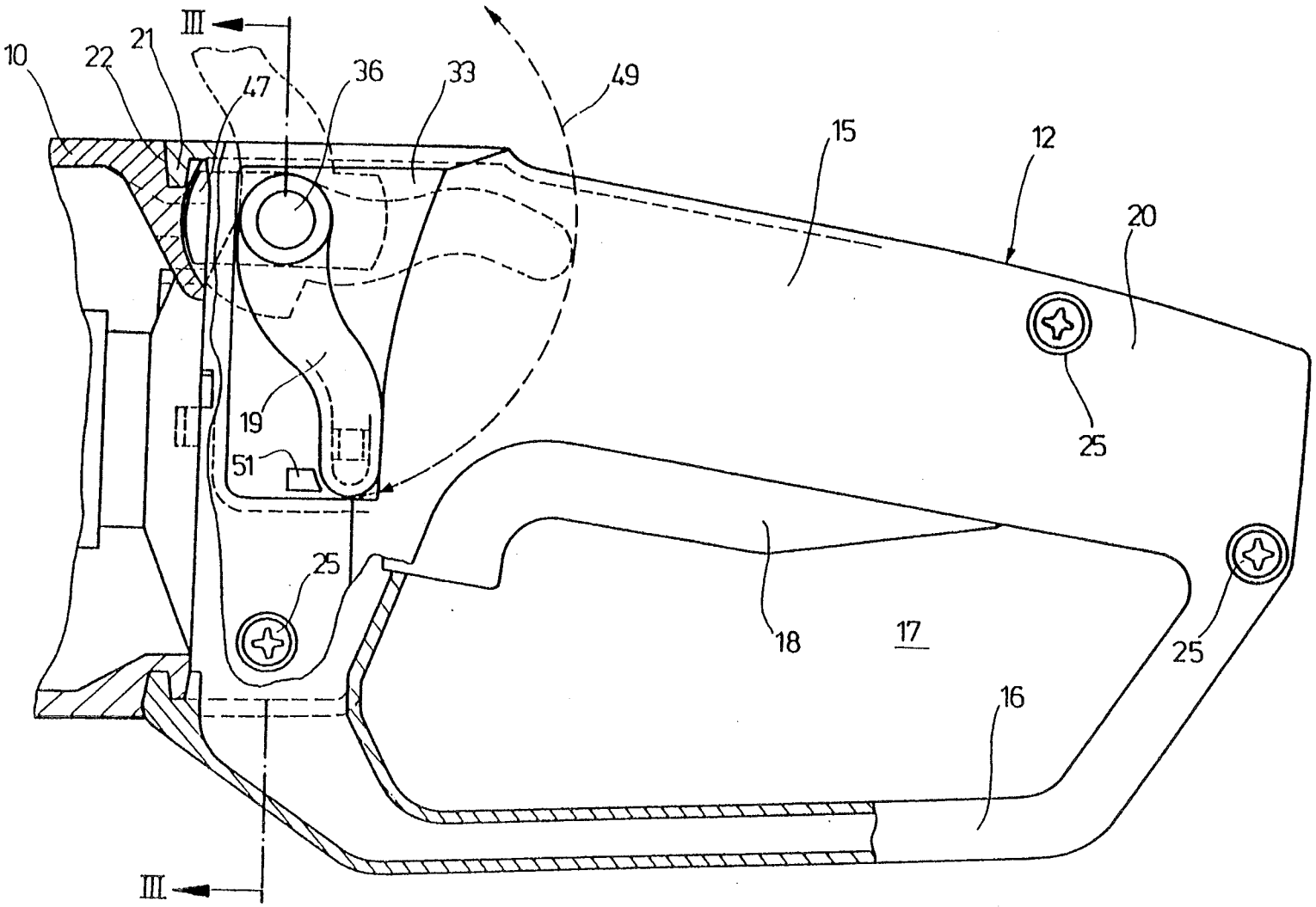
FIG. 2 is a side view, partly in section, of the handle together with a part of the motor casing of the angle grinding machine shown in FIG. 1.
Figure 3:
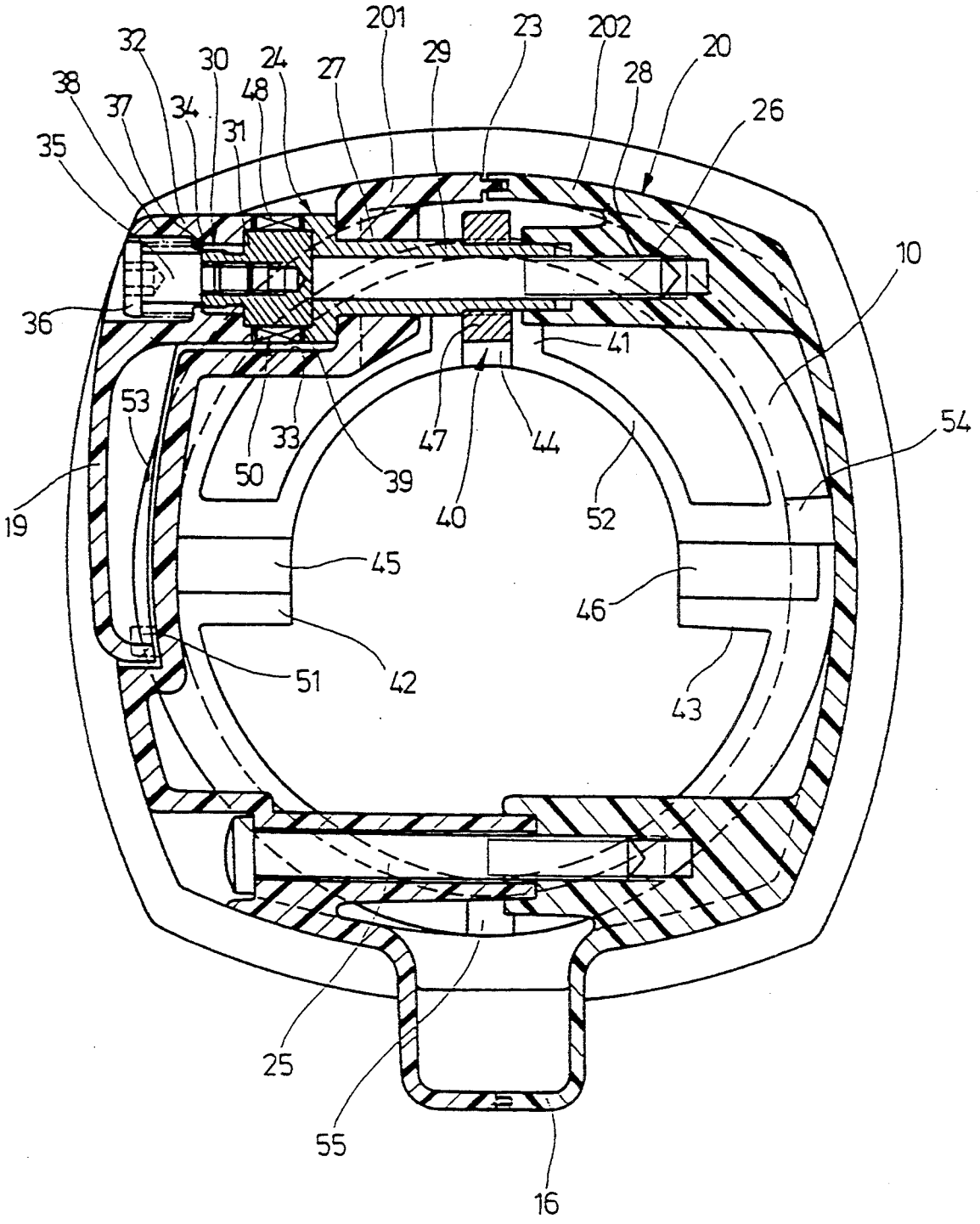
FIG. 3 is a section on the line III—III in FIG. 2.

The locking device 40 enables the handle 12 to be fixed in three different turned positions on the motor casing 10, namely in a normal position shown in FIGS. 1 to 3, and two positions in which it is turned 90° and which can be achieved by turning the handle 12 about the longitudinal axis of the casing to the right or left from the normal position. For this purpose, the motor casing 10 carries three casing pegs 41–43 which are offset 90° relative to one another and which project radially into the interior, each of them bearing a locking slot 44–46. A web 52 in the form of a circular arc connects the three locking pegs 41–43 to one another and is integrally attached to the free end of each of the casing pegs 41–43. A locking cam 47 cooperates with the locking slots 44–46 and can be swivelled to engage positively in the locking slots 44–46 in order to fasten the handle 12 on the motor casing 10. The bolt-shaped locking cam 47, the shape of which can be seen in FIG. 2, is mounted on and rotatable with the coupling sleeve 29, which is a component of the locking device 40. The coupling sleeve 29 is mounted rotatably on the tightening screw 26 of the clamp device 24 and, on an annular web 39 which is disposed around the first coupling part 31 of the toothed clutch 30, carries claws 48 of a claw clutch 50 which cooperate with corresponding claws 48 on the end face of the second coupling part 32 of the toothed clutch 30. The claws 48 on the coupling sleeve 29 and on the second coupling part 32 are so designed that, when the second coupling part 32 is moved axially in order to release the toothed clutch 30, the claws 48 remain in engagement with one another, so that the claw clutch 50 is not released at the same time.

In order to clamp and lock the handle 12 on the motor casing 10, the handle 12 has to be turned so that the locking cam 47 is in alignment with one of the locking slots 44–46. The tightening lever 19 must then be swivelled downwards, in the direction of the arrow 49, out of the position shown in dashed lines in FIG. 2, in which it projects over the handle 12. In this swivelling movement, on the one hand, the coupling sleeve 29 is turned by the claw clutch 50, so that the locking cam 47 is swivelled into the corresponding locking slot 44–46, while on the other hand the toothed clutch 30 turns the tightening screw 26, which is thus screwed further into the threaded hole 28 and thereby moves the two half-shells 201 and 202 of the shell casing 20 towards one another, thus reducing the width of the longitudinal slot 23. Through this movement of the half-shells 201, 202 in the region of the longitudinal slot 23, the collar 21 of the shell casing 20 is pressed radially against the bottom of the groove 22 extending around the motor casing 10 and the handle 12 is clamped on said motor casing. At the end of the swivelling movement, the tightening lever 19 strikes against a stop 51 disposed on the outside of the shell casing 20. In this end position of the tightening lever 19, the locking cam 47 has been fully swivelled into the corresponding locking slot 44–46.

For the purpose of adjusting the clamping force of the tightening screw 26, the tightening lever 19 has to be pulled out axially away from the shell casing 20 until the compression of the compression spring 38 to its solid length stops further movement. In this position, the teeth 34 of the toothed clutch 30 are out of engagement, and the tightening lever 19 is separated from the tightening screw 26. Since the claw clutch 50 remains closed, the connection between the locking cam 47 and the tightening lever 19 is maintained. The tightening lever 19, uncoupled from the tightening screw 26, is then swivelled back to a small extent, away from the stop 51, in the direction of the arrow 49, and then released again. When said lever is released, the stressed compression spring 38 brings the coupling parts 31 and 32 of the toothed clutch 30 back into engagement, and the tightening lever 19 and tightening screw 26 are once again joined together for rotation with one another. The tightening lever 19 is again swivelled in the direction of the arrow 49 until it reaches the stop 51, and at the same time the tightening screw 26 is screwed further into the threaded hole 28.

Figure 4:
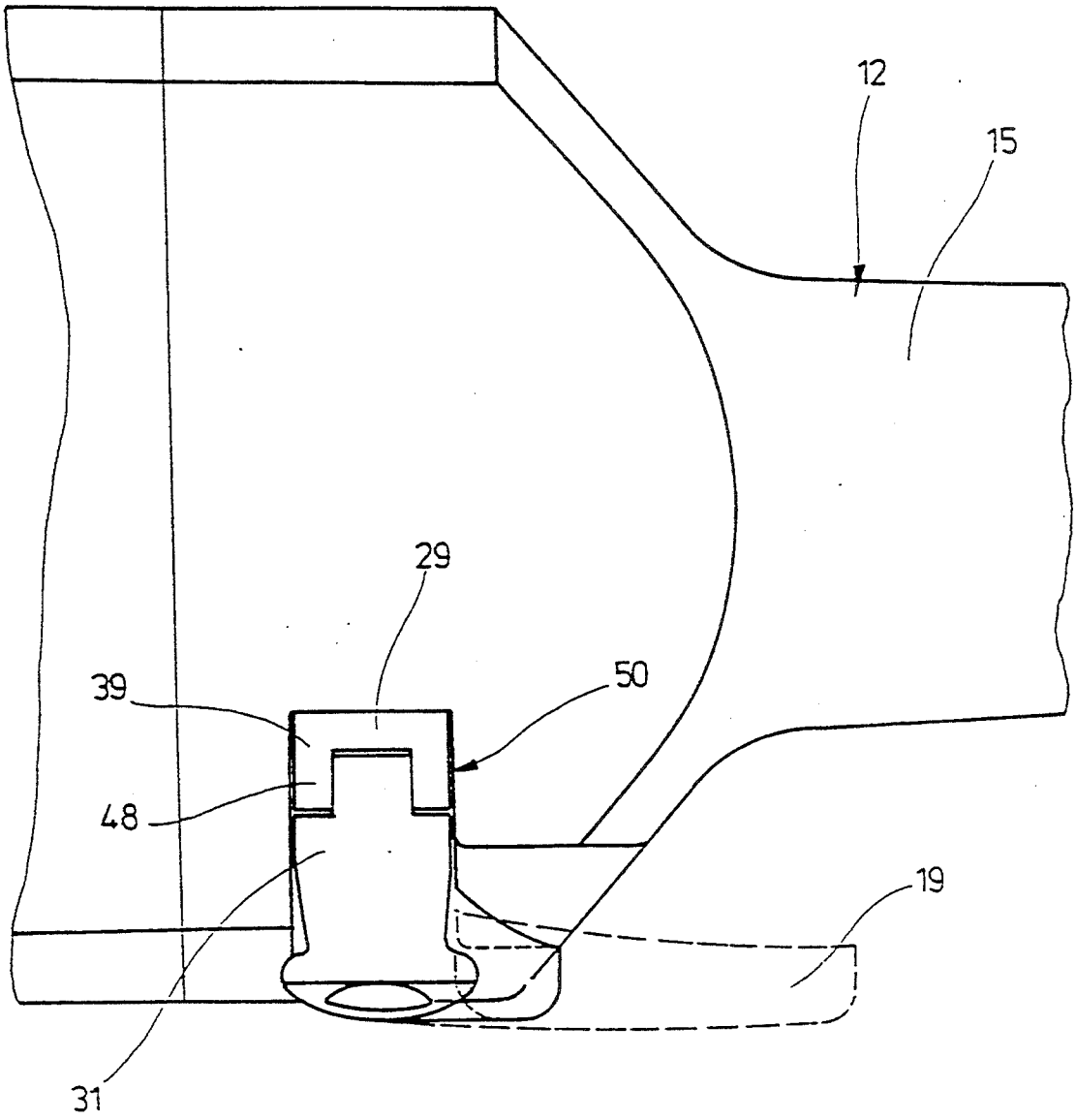
FIG. 4 is a partial plan view of the handle shown in FIG. 2.

In the position of the handle 12 relative to the motor casing 10 shown in FIG. 3, in which the locking cam 47 is engaged in the middle locking slot 44, the angle grinding machine is in a working position used for scouring. For cutting work, the clamp device 24 and the locking device 40 have to be released with the aid of the tightening lever 19, and the handle 12 has-to be turned 90° to the right or the left. This turning movement is limited by two stop lugs 53, 54 inside the motor casing 10 and a stop boss 55 inside the shell casing 20. When the stop lug 53 or 54 bears against the stop boss 55, the locking cam 47 is in alignment with the locking slot 45 or 46. In this position, the handle 12 is then locked and clamped fast on the motor casing 10, by operating the tightening lever 19, in the same way as previously described. In all other positions of the handle 12 relative to the motor casing 10, operation of the tightening lever 19 is prevented by the fact that the locking cam 47 is directly in front of the arcuate web 52 and thus cannot be swivelled. The tightening lever 19 is then in the middle position shown in dashed lines in FIG. 2. As can be seen in the partial plan view of the handle 12 shown in FIG. 4, in this position the tightening lever 19 projects a long way along the stem grip 15 and prevents the user's hand from gripping around the stem grip 15 at this point. The user of the angle grinding machine is thus made aware that the handle 12 is not correctly locked and clamped to the motor casing 10. In the plan view shown in FIG. 4, the claw clutch 50 between the first coupling part 31 of the toothed clutch 30 and the coupling sleeve 29 can once again be seen clearly.

Figure 5:
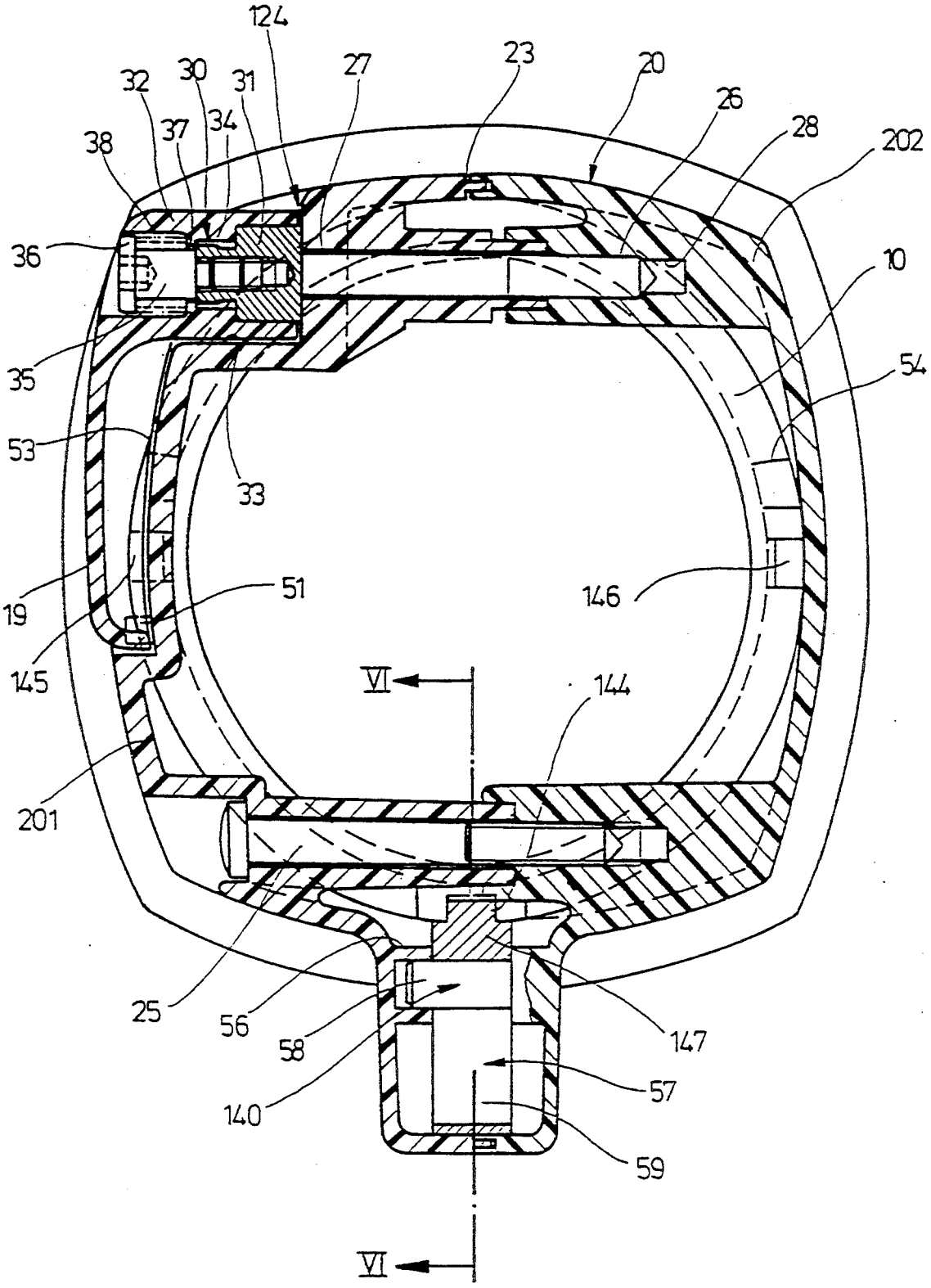
FIG. 5 is a similar section to FIG. 3, showing an angle grinding machine according to another example of embodiment.
Figure 6:
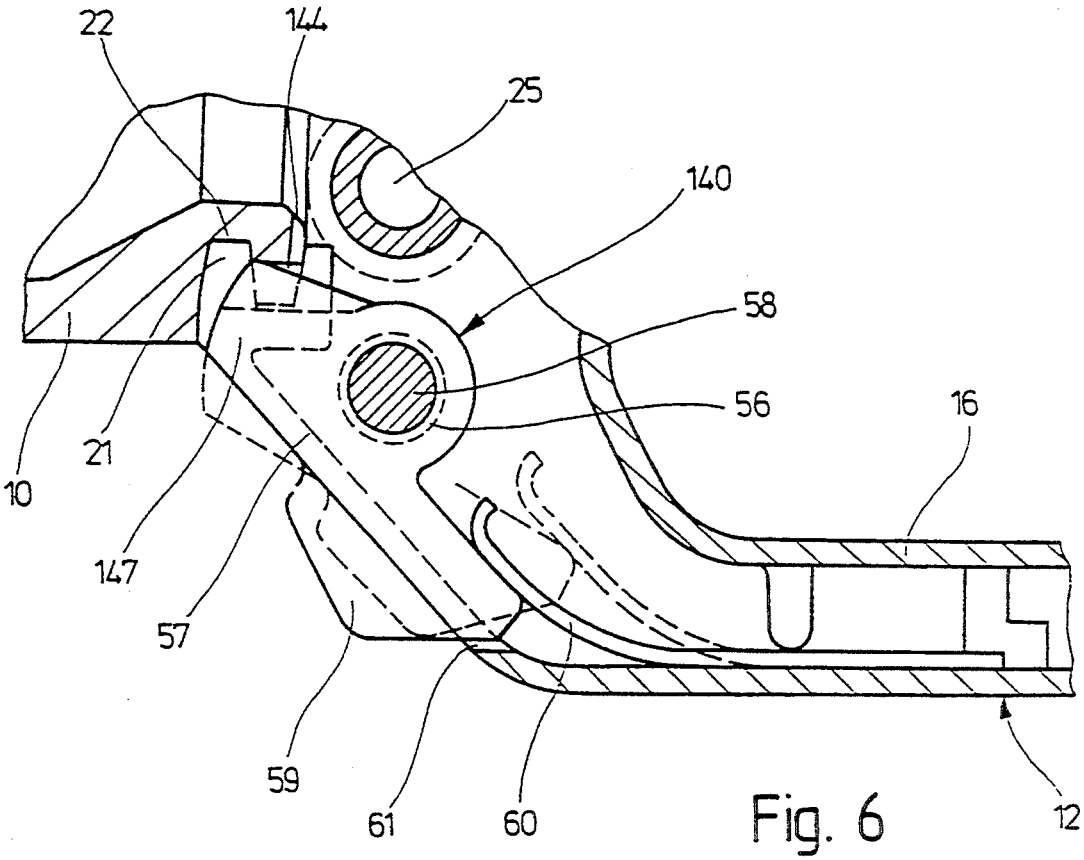
FIG. 6 is a partial longitudinal section on the line VI—VI in FIG. 5.

In the example of embodiment of an angle grinding machine shown in FIGS. 5 and 6, the clamp device 124 and the locking device 140 are made separate from one another and must be operated separately. Handling is consequently rather more complicated, but the construction is more advantageous in respect of production costs.

The clamp device 124 is unchanged and is identical with the clamp device 24 in FIG. 3. The coupling sleeve which surrounds the tightening screw 26, and which is a component of the locking device 40 in FIG. 3, is dispensed with, so that the first coupling part 31 of the toothed clutch 30 is supported directly on the wall portion of the cavity 33 in the shell casing 20. Identical components in FIG. 5 are therefore given the same reference numerals as in FIG. 3.

The locking device 140 is disposed diametrically opposite the clamp device 124 at the front transition of the bow 16 into the stem grip 15 of the handle 12. A locking lever 57 is mounted swivellably by means of a bearing pin 58 in a bearing sleeve 56 attached integrally to the half-shell 201. One arm of the locking lever 57 is in the form of an operating button 59, while the other arm of the lever forms the locking cam 147. The locking lever 57 is disposed in a recess 61 in the bow 16 and is loaded by a bending spring 60 in such a manner that the operating button 59 projects out of the recess 61 in the bow 16 (FIG. 6). In this arrangement, the locking cam 147 engages in one of three locking slots 144–146, which are disposed on the outside of the motor casing 10. The locking slots 144–146 are once again offset 90° in relation to one another, so that the handle 12 can be turned in the same way and locked and clamped in the same turned positions. When the required position is reached, the locking cam 47 automatically drops, through the action of the bending spring 60, into the respective locking slot 144–146, so that it is then only necessary to operate the tightening lever 19 in the manner described. It is only for releasing the clamp device 24 and the locking device 140 that two different levers have to be operated.

Figure 8:
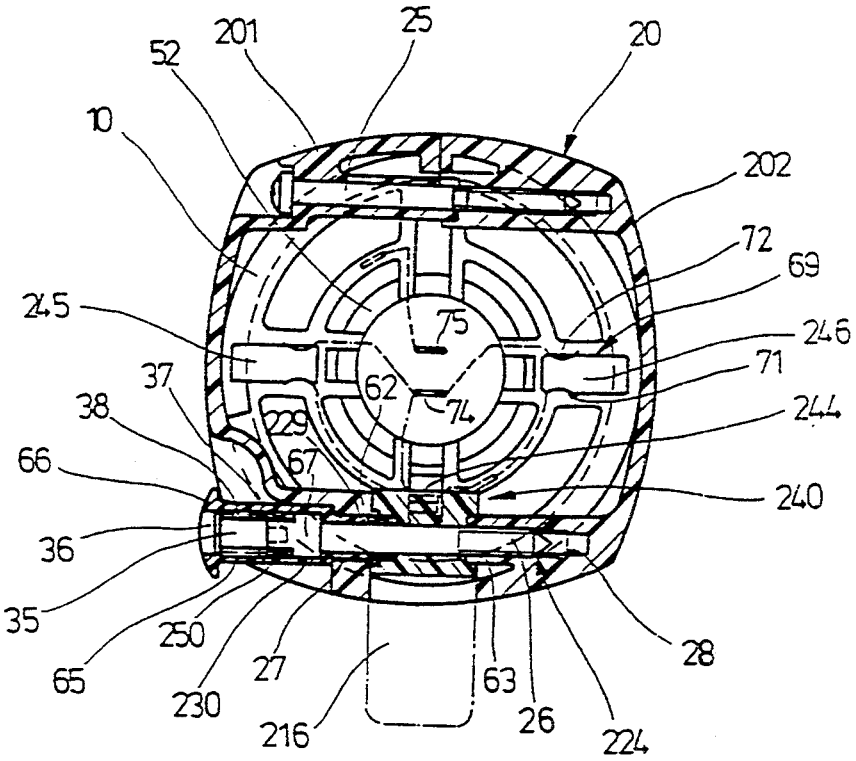
FIG. 8 is a section on the line VIII—VIII in FIG. 7.
Figure 7:
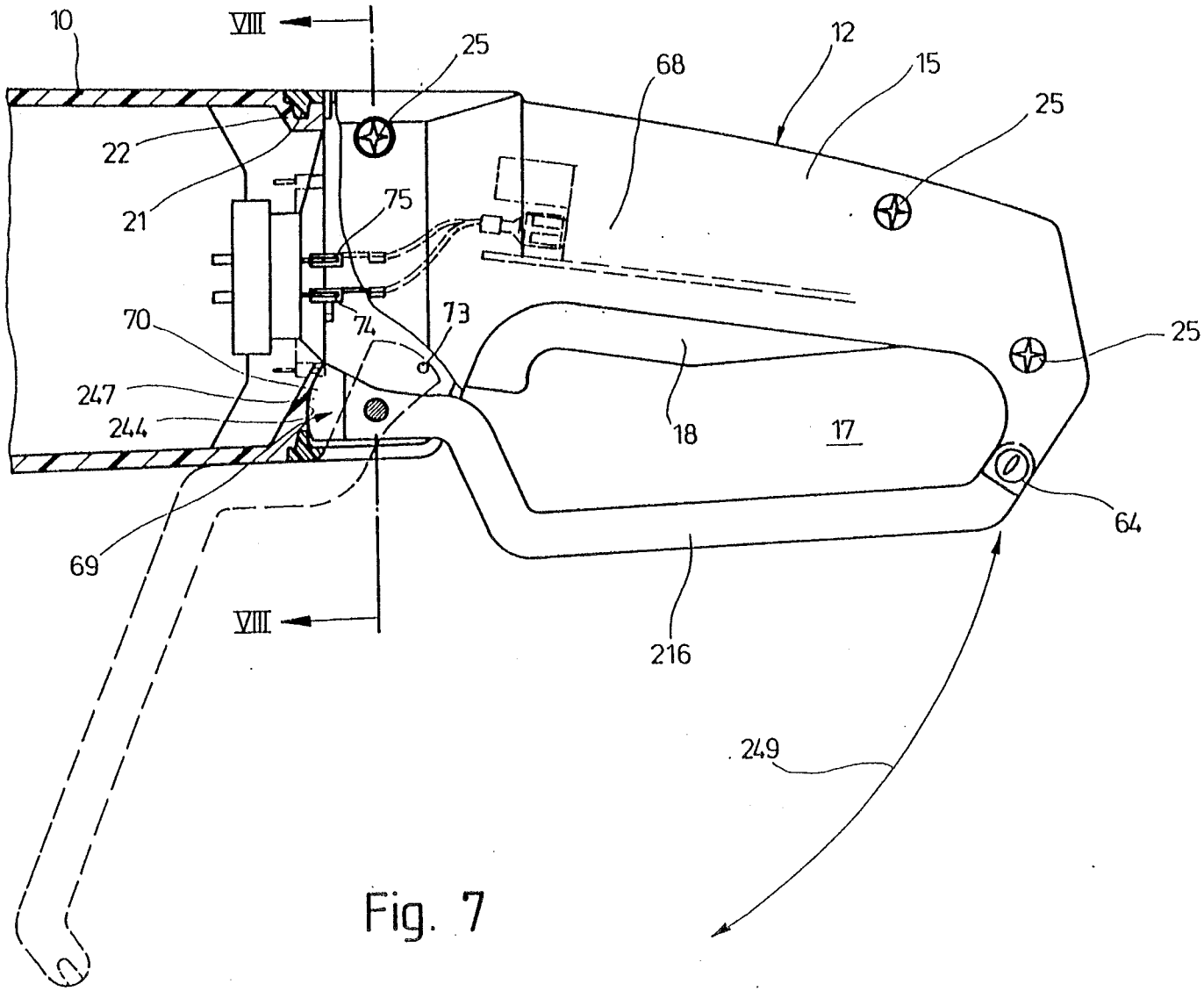
FIG. 7 is a side view, partly in section, of a handle and part of the casing of an angle grinding machine according to a third example of embodiment.

In the additional example of embodiment of an angle grinding machine, of which part is show in FIGS. 7 and 8, the bow 216 of the handle 12 functions at the same time as a tightening lever for synchronous operation of the clamp device 224 and the locking device 240. For this purpose, the bow 216 is held at one end for rotation on two bearing pins 62, 63 which project inwards on one of the half-shells 201 or 202 respectively and are in alignment with one another. The other end of the bow 216 is detachably fastened on the stem grip 15 by means of a snap fastener 64 (FIG. 7).

The clamp device 224 (FIG. 8) once again embraces the tightening screw 26, which on the one hand passes through the bore 27 in the half-shell 201 and on the other hand can be screwed into the threaded hole 28 in the other half-shell 202. In this arrangement, the bore 27 is formed in one bearing pin 62 and the threaded hole 28 coaxially in the other bearing pin 63. A coupling sleeve 229, joined to the bow 216 for rotation therewith, is once again mounted for rotation on the tightening screw 26. The coupling sleeve 229 is operatively connected to an uncoupling member 65 by a toothed clutch 230 disposed on its end face. The uncoupling member 65, which is in the form of a hollow cylinder, carries at its free end an integrally attached mushroom handle 66 and surrounds a screwhead-shaped portion 67 of the tightening screw 26. A bolt 35 bearing a collar 36 is screwed into the end face of said portion 67. The compression spring 38 is supported between the collar 36 and an annular web 37 in the interior of the uncoupling member 65. The axial length of the coupling teeth of the toothed clutch 230 and the solid length of the compression spring 38 are once again adapted to one another in such a way that, when the uncoupling member 65 is pulled out against the force of the compression spring 38, the coupling teeth of the toothed clutch 230 come out of engagement before the axial movement of the uncoupling member 65 is blocked by the compression of the compression spring 38 to its solid length. The uncoupling member 65 is connected via a claw clutch 250 to the portion 67 of the tightening screw 26 for rotation therewith. The claw clutch 250 is so designed that this co-rotational connection is still maintained when the toothed clutch 230 is released.

The locking device 240 and the clamp device 224 are coupled by constraint and operated simultaneously by means of the bow 216. For this purpose, the locking cam 247 (FIG. 7) is formed at the free end, projecting beyond the swivel point, of the bow 216 and can be swivelled into three locking slots 244–246 in the motor casing 10. The locking slots 244–246 are once again formed in casing pegs of the motor casing 10, these pegs, offset 90° relative to one another, projecting into the interior of the casing and being connected by the web 52, which is in the shape of a circular arc. When the bow 216 is fastened to the stem grip 15 by the snap fastener 64, the locking cam 247 engages positively in one of the three locking slots 244–246. If, after releasing the snap fastener 64, the bow 216 is swivelled in the direction of the arrow 249 into the position shown in dashed lines in FIG. 7, the locking cam 247 will be swivelled out of the respective locking slot 244–246.

As an additional safety measure, a breaker contact 69 is disposed between the on/off switch 68 (FIG. 7) operated by the switch bar 18—for the electric drive motor of the angle grinding machine—and the drive motor, said contact is closed only when the bow 216 has engaged in the snap fastener 64 on the stem grip 15 and thus the locking cam 247 has been swivelled into one of the three locking slots 244–246. If the locking cam 247 has been swivelled out of the respective locking slot 244–246, the breaker contact 69 is opened automatically and all current supply to the electric drive motor is interrupted. In order to form this breaker contact 69, two contact springs 71, 72 are disposed in each locking slot 244–246 and are connected together by way of a contact bridge 70, which has two lateral contact surfaces 73 on the locking cam 247, when the locking cam 247 has been swivelled into the slot. One contact spring 71 in all three locking slots 244–246 is connected to a first plug contact 74 and the other three contact springs 72 of the locking slots 244–246 are connected to a second plug contact 75. While the first plug contact 74 is connected to an output of the two-pole on/off switch 68, a current brush of the electric drive motor is connected to the second plug contact 75.

The mode of operation of the locking device 240 and clamp device 224, which are coupled by constraint, is similar to that described in connection with FIGS. 1 to 3. When the bow 216 is swivelled in the direction of the arrow 249, after release of the snap fastener 64, the locking cam 247 is swivelled out of the locking slot 244 and at the same time the supply of current to the electric drive motor is cut off. As the bow 216 is swivelled, the tightening screw 26 is screwed further out of the threaded hole 28 by means of the coupling sleeve 229, the toothed clutch 230, the uncoupling member 65 and the claw clutch 250, so that the clamp connection between the collar 22 on the shell casing 20 and the groove 22 extending around the motor casing 10 is released. The handle 12 can then be swivelled 90° to the left or right into the new working position. The bow 216 is then swivelled back and locked in the snap fastener 64. The locking cam 247 is thus swivelled into the corresponding locking slot 245 or 246, the contact bridge 70 on the locking cam 247 connects the two contact springs 71, 72, and the breaker contact 69 is closed. The tightening screw 26 is turned once again and screwed further into the threaded hole 28 by the coupling sleeve 229 rotating with the bow 216, with the aid of the toothed clutch 230 and the claw clutch 250. The two half-shells 201, 202 are thus clamped fast on the motor casing 10 in the manner described. The clamping force can be adjusted by means of the uncoupling member 65 with the mushroom handle 66. Said member has to be pulled against the force of the compression spring 38, to be precise away from the shell casing 20, until further movement is stopped when the compression spring 38 has been compressed to its solid length. In this position, the toothed clutch 230 is released and the bow 216 can be swivelled back to a small extent without turning the tightening screw 26. When the mushroom handle 66 is released, the compression spring 38, with the aid of the toothed clutch 230, restores the co-rotational connection between the bow 216 and the tightening screw 26. The bow 216 can again be locked in the snap fastener 64, and the tightening screw 26 screwed further into the threaded hole 28, so that the clamping force is increased.

The invention is not restricted to the example of embodiment described. Thus, the handle may be joined fast to the motor casing and the gear head be joined rotatably to the latter. The clamping and locking device should then be disposed between the gear head and the motor casing.

It will be understood that each of the elements described above, or two or more together, may also find a useful application in other types of constructions differing from the types described above.

While the invention has been illustrated and described as embodied in an electric hand machine tool, particularly an angle grinding machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An electric hand machine tool, comprising a motor casing having two end faces; a gear head element projecting from one of said end faces of said casing for connecting with a tool; a handle element extending from the other of said end faces of said casing, at least one of said elements including said handle element and said gear head element being held rotatably on said motor casing and being secured both frictionally and positively in at least two turned positions manually and with the aid of a tightening lever; a locking device providing a positive connection particularly of a catch type of said at least one element with said motor casing; and a clamp device providing a frictional connection particularly of a tightenable type of said at least one element with said motor casing.

2. An electric hand machine tool as defined in claim 1, wherein said gear head element carries a tool mounting.

3. An electric hand machine tool as defined in claim 1, wherein said handle element has an ergonomically situated switch bar for switching an electric drive.

4. An electric hand machine tool as defined in claim 1, wherein said clamp device is located diametrically opposite said locking device.

5. An electric hand machine tool as defined in claim 1, wherein said motor casing has a peripherally extending groove, said at least one element having a shell casing with a radially projecting collar engaging in said groove of said motor casing, said shell casing being provided in a region of said collar with a longitudinal slot, said clamp device having a tightening screw extending transversely to said longitudinal slot and screwable into a screw thread so that casing regions located at both sides of said longitudinal slot can be moved toward one another to reduce a width of said longitudinal slot.

6. An electric hand machine tool as defined in claim 5, wherein said tightening lever is arranged to screw said tightening screw into the screw thread.

7. An electric hand machine tool as defined in claim 6; and further comprising a stop which limits a swiveling movement of said tightening lever so as to fix a tightening and locking position.

8. An electric hand machine tool as defined in claim 6; and further comprising a toothed clutch which makes a connection of said tightening screw and said tightening lever and releasable by an axial movement of said tightening lever.

9. An electric hand machine tool as defined in claim 8, wherein said toothed clutch has a first coupling part which is joined to said tightening screw for rotation therewith, a second coupling part which is joined to said tightening lever for rotation therewith and coaxially surrounds said first coupling part, and a compression spring effecting an engagement of said two coupling parts and supported between said second coupling part and a radial support shoulder of said first coupling part, said toothed clutch having interengaging coupling teeth with an axial length which is adapted to a solid length of said compression spring so that through an axial movement of said second coupling part against a restoring force of said compression spring, a coupling teeth of said two coupling parts can be brought out of engagement.

10. An electric hand machine tool as defined in claim 9, wherein said second coupling part of said toothed clutch is integral with said tightening lever, said tightening lever extending at right angles to said second coupling part and being disposed laterally on said shell casing.

11. An electric hand machine tool as defined in claim 9, wherein said locking device has at least two locking slots located in said motor casing and offset by an angle, and a locking cam swivelable in said shell casing and positively engageable alternatingly in each of said locking slots.

12. An electric hand machine tool as defined in claim 11, wherein said motor casing having casing pegs projecting radially into its interior and forming said locking slots, at least two of said casing pegs being connected together by a web having the shape of a circular arc and being disposed so that it prevents swiveling of said locking cam.

13. An electric hand machine tool as defined in claim 11, wherein said motor housing has a stop boss and said shell casing has at least one stop lug cooperating with said stop boss, said stop boss and said stop lug being disposed relative to one another so that they bear against one another, said locking cam and said locking slot of said locking device being in alignment with one another.

14. An electric hand machine tool as defined in claim 11, wherein said handle element has an ergonomically situated switch bar for switching on an electric drive; and further comprising a breaker contact having a contact element which is disposable in each of said locking slots and on said locking cam; an electric drive motor; an on/off switch; and an electric connecting line provided between said on/off switch and said electric drive motor, said breaker contact being connected in said electric connecting line and designed so that it is closed only when said locking cam has been swiveled into said locking slot.

15. An electric hand machine tool as defined in claim 14; and further comprising first and second plug contacts and two contact springs provided in each of said locking slots and located opposite one another at a distance from each other, one of said contact springs being connected to said first plug contact while the other of said contact springs is connected to said second plug contact, said on/off switch being formed as a two-pole switch which has an output connected to said first plug contact, said electric drive having one current brush connected to said second plug contact, said locking cam having on two opposite sides contact surfaces; and a contact bridge which connects said contact surfaces with one another and bears against said two contact springs when said locking cam is in a locking position in said locking slot.

16. An electric hand machine tool as defined in claim 11, wherein said locking device has a coupling sleeve, said locking cam being mounted on and rotatable with said coupling sleeve, said coupling sleeve coaxially surrounding said tightening screw and being operatively connected to said coupling part of said toothed clutch; and a claw clutch connecting said coupling sleeve with said second coupling part of said toothed clutch and formed so that coupling parts of said claw clutch remain in engagement with one another on uncoupling of said toothed clutch by an axial movement of said second coupling part.

17. An electric hand machine tool as defined in claim 16, wherein said shell casing has an external cavity, said toothed clutch and said claw clutch and also their coupling parts being located in said external cavity of said shell casing and only said tightening screw and said coupling sleeve project into an interior of said shell casing.

18. An electric hand machine tool as defined in claim 5, wherein said locking device has at least two locking slots located in said motor casing and offset by an angle, and a locking cam swivelable in said shell casing and positively engageable alternatingly in each of said locking slots, said locking cam being mounted on and rotatable with a locking lever which is held swivelably in said shell casing and spring loaded in direction in which said locking cap is swiveled into said locking slot, said locking lever projecting sufficiently far out of said shell casing for manual operation against a spring force.

19. An electric hand machine tool as defined in claim 18; and further comprising a bending spring which loads said locking lever and provides said spring force.

20. An electric hand machine tool as defined in claim 18, wherein said motor casing has an outer peripheral surface, said locking slots being located in said outer peripheral surface of said motor casing.

21. An electric hand machine tool as defined in claim 18, wherein said motor housing has a stop boss and said shell casing has at least one stop lug cooperating with said stop boss, said stop boss and said stop lug being disposed relative to one another so that they bear against one another, said locking cam and said locking slot of said locking device being in alignment with one another.

22. An electric hand machine tool as defined in claim 18, wherein said handle element has an ergonomically situated switch bar for switching an electric drive and a bow which covers said switch bar at a distance therefrom and has a recess, said locking lever being disposed in said bow and having an operating surface projecting out of said recess of said bow.

23. An electric hand machine tool as defined in claim 22, wherein said bow is integral with said handle element.

24. An electric hand machine tool as defined in claim 1, wherein said locking device has at least two locking slots located in said motor casing and offset by an angle, and a locking cam swivelable in said shell casing and positively engageable alternatingly in each of said locking slots, said handle element having an ergonomically situated switch bar for switching on an electric drive; and further comprising a breaker contact having a contact element which is disposable in each of said locking slots and on said locking cam; an electric drive motor; an on/off switch; and an electric connecting line provided between said on/off switch and said electric drive motor, said breaker contact being connected in said electric connecting line and designed so that it is closed only when said locking cam has been swiveled into said locking slot.

25. An electric hand machine tool as defined in claim 24; and further comprising first and second plug contacts and two contact springs provided in each of said locking slots and located opposite one another at a distance from each other, one of said contact springs being connected to said first plug contact while the other of said contact springs is connected to said second plug contact, said on/off switch being formed as a two-pole switch which has an output connected to said first plug contact, said electric drive having one current brush connected to said second plug contact, said locking cam having on two opposite sides contact surfaces; and a contact bridge which connects said contact surfaces with one another and bears against said two contact springs when said locking cam is in a locking position in said locking slot.

26. An electric hand machine tool as defined in claim 6; and further comprising an uncoupling member providing a connection between said tightening screw and said tightening lever; a toothed clutch by which said uncoupling member is connected with said tightening lever; and a claw clutch by which said uncoupling member is connected to said tightening screw, said toothed clutch being releasable through an axial movement of said uncoupling member.

27. An electric hand machine tool as defined in claim 26; and further comprising a coupling sleeve coaxially surrounding said tightening screw and carrying one toothed ring of said toothed clutch, said tightening lever being held swivelably and coaxially with said tightening screw in said shell casing and being joined to and rotatable with said coupling sleeve, said uncoupling member being formed as a sleeve which is provided with a mushroom handle and carrying another toothed ring of said toothed clutch.

28. An electric hand machine tool as defined in claim 27, and further comprising a compression spring effecting an engagement of said toothed rings of said toothed clutch, said toothed clutch having interengaging coupling teeth with an axial length which is adjusted with respect to a solid length of said compression spring so that through an axial movement of said uncoupling member against a storing force of said compression spring, the coupling teeth of said toothed clutch can be brought out of engagement.

29. An electric hand machine tool as defined in claim 27, wherein said locking device has at least two locking slots located in said motor casing and offset by an angle and a locking cam attached to said tightening lever and positively engageable alternatively in each of said locking slots.

30. An electric hand machine tool as defined in claim 29, wherein said locking cam is integrally attached to said tightening lever.

31. An electric hand machine tool as defined in claim 29, wherein said handle element has an ergonomically situated switch bar for switching on an electric drive, said tightening lever being formed as a bow which covers said switch bar at a distance therefrom and which at its remote from its pivot point is lockable to said handle element; and further comprising a snap fastener locking said tightening lever to said handle element.

* * * * *